US006086223A

United States Patent [19]

Fogle et al.

[11] Patent Number: 6,086,223

[45] Date of Patent: Jul. 11, 2000

[54] PAD LOCK LIGHTING DEVICES

[76] Inventors: Mary Fogle, P.O. Box 2322, Kerrville, Tex. 78029; Steve Price, P.O. Box 232, Hunt, Tex. 78024

[21] Appl. No.: 09/039,542

[22] Filed: Mar. 15, 1998

[51] Int. Cl.[7] ..... F21V 33/00

[52] U.S. Cl. ..... 362/253; 362/23; 70/25

[58] Field of Search ..... 362/253, 23, 100, 362/116; 70/25, 51, 330

[56] References Cited

U.S. PATENT DOCUMENTS

| | | | |
|---|---|---|---|
| 4,078,248 | 3/1978 | Hill . | |
| 4,683,741 | 8/1987 | Fields . | |
| 4,964,023 | 10/1990 | Nishizawa et al. | 362/100 |
| 5,057,975 | 10/1991 | Evigan | 362/100 |
| 5,179,325 | 1/1993 | Argon, Jr. | 315/138 |
| 5,541,817 | 7/1996 | Hung . | |
| 5,611,613 | 3/1997 | Bergen et al. . | |
| 5,715,709 | 2/1998 | Lai | 70/25 |
| 5,832,752 | 11/1998 | Zeller | 70/30 |

*Primary Examiner*—Sandra O'Shea
*Assistant Examiner*—John A. Ward
*Attorney, Agent, or Firm*—Gunn, Lee & Keeling

[57] ABSTRACT

The invention is of a design for both an internally based design feature and add-on accessories, both of which provide lighting which is directed to the dial(s) of conventional combination pad locks. Applicant's invention permits lock users to operate pad locks in darkened conditions, without needing any ancillary lighting or lighting accessories (flashlights, etc.).

2 Claims, 3 Drawing Sheets

PAD LOCK LIGHTING DEVICES

BACKGROUND OF THE INVENTION

1. Field of the Invention

Applicant's invention relates to locks, and more particularly to pad locks and accessories useful in association therewith.

2. Background Information

Pad locks in this country are ubiquitous. They are used in countless settings, including many in which, during the dark hours, are not lighted sufficiently to enable a user to operate the lock without added, artificial light.

The problem of operating a lock with inadequate light is exacerbated when a combination lock is involved. Most people can "grope" for the keyhole in a keyed lock, but there is no such option with a combination lock. One either visualizes the dial or thumb rollers, or he or she will not be able to operate the lock—it is that simple.

The typical solutions to such a problem as not being able to see a combination lock in the dark involve trying to hold a flashlight in one's mouth (it usually takes both hands to effectively operate a combination pad lock), in some cases, such as outside gates, trying to orient one's vehicle where the headlights will shine on the lock, lighting a match or cigarette lighter (with obvious hazards), or in some way trying to orient the lock in a way that some ambient light might just be reflected sufficiently to enable the user to see well enough to operate the lock. Of course, flashlights are not always available (or working), a vehicle is not always nearby, most people these days do not carry matches or cigarette lighters, and there may not be any ambient light.

Thus far, no provider of pads locks has made available any solution to the problems described above, which solutions reside with the lock itself.

It would be desirable to provide some means by which a dial(s) of a combination pad lock can be illuminated by some feature or accessory of the lock itself.

SUMMARY OF THE INVENTION

It is an object of the present invention to provide a novel design alteration for existing pad lock design which provides lighting for user operable portions of the surfaces thereof.

It is another object of the present invention to provide a novel accessory for use with existing pad locks which provides lighting for user operable portions of the surfaces thereof.

In satisfaction of these and related objectives, Applicant's present invention provides a design for both an internally based design feature and an add-on accessories, both of which provide lighting which is directed to the dial(s) of conventional combination pad locks. Applicant's invention permits lock users to operate pad locks in darkened conditions, without needing any ancillary lighting or lighting accessories (flashlights, etc.).

DETAILED DESCRIPTION OF THE PREFERRED EMBODIMENT

Figure 1:
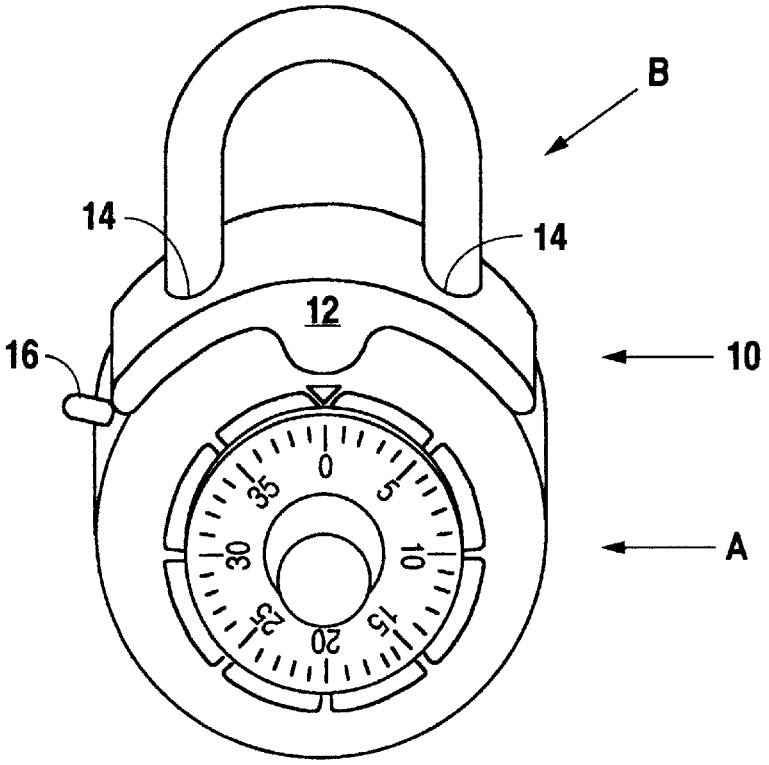
FIG. 1 is a perspective view of an embodiment of the present invention shown mounted on a conventional combination pad lock with a front dial configuration.
Figure 2:
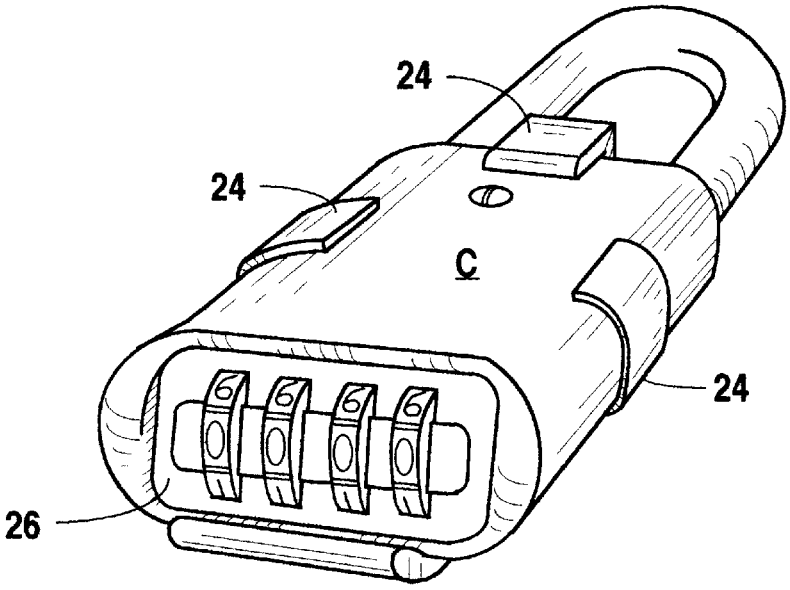
FIG. 2 is a perspective, bottom view of a lock with case bottom positioned combination dials with a second embodiment of the present invention shown engaged therewith.
Figure 3:
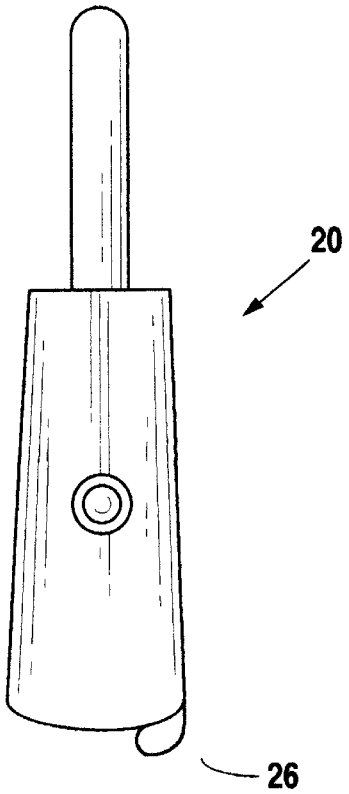
FIG. 3 is an elevational side view of the assemblage of FIG. 2.
Figure 4:
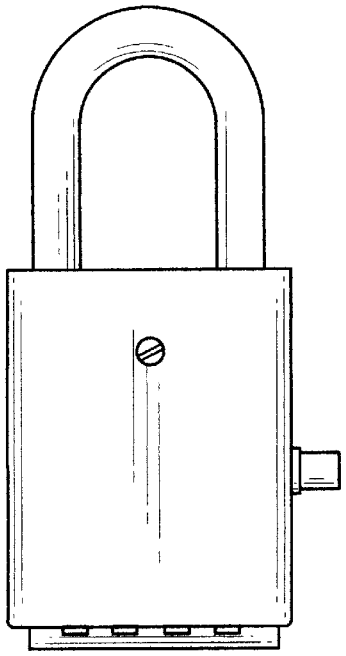
FIG. 4 is front elevational view of the assemblage of FIG. 2.
Figure 5:
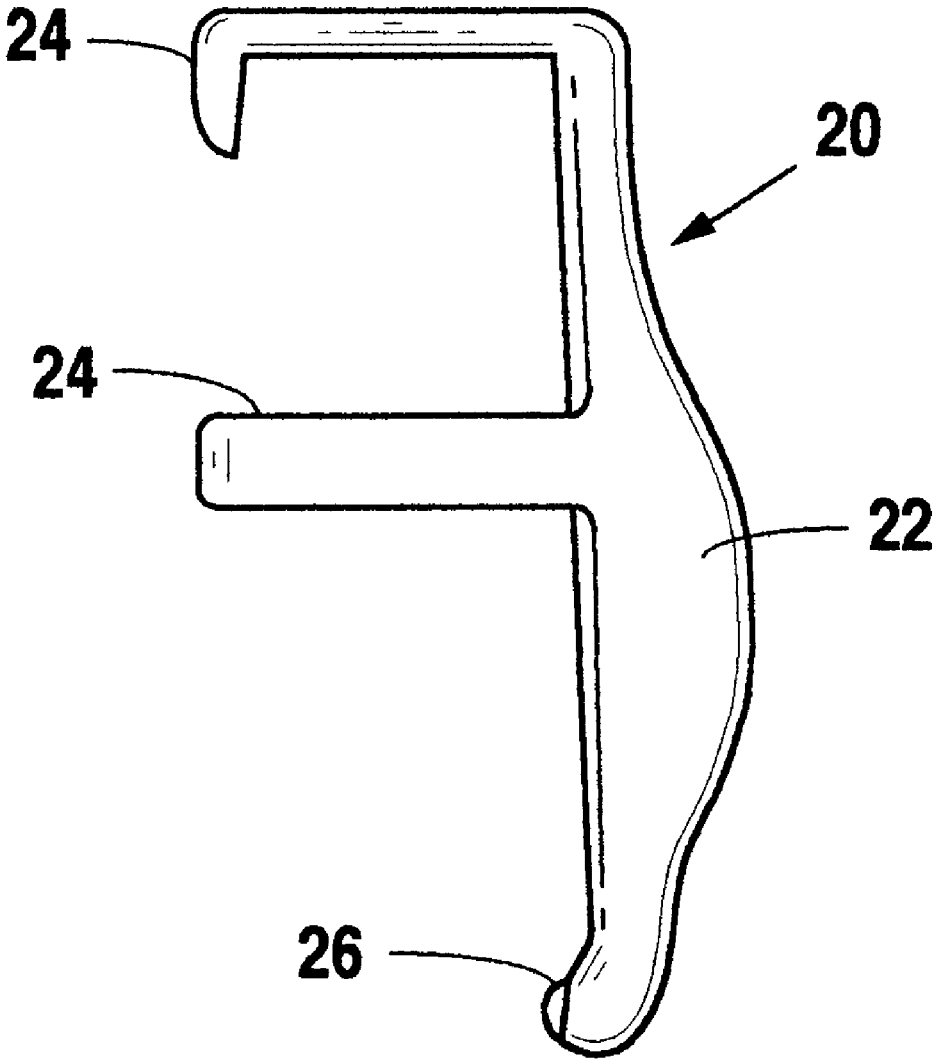
FIG. 5 is an elevational view of the second embodiment of the present lighting accessory invention, as shown in FIGS. 2, 3 and 4.

Referring to FIG. 1, an accessory of the present invention for addition to an existing pad lock A is identified by the reference numeral 10. Although different embodiments may appear completely different, from a visual appearance standpoint, lighting accessory 10 will, in any form, involve a casing 12 from which extends a light bulb casing 14 in which a light bulb or other low power LED type light source is encased. Internal to casing 12 is a power source (such a watch battery type cells [not shown in the drawings]) and some switching means which serves to close the lighting circuit and actuate the light.

The preferred embodiment of accessory 10 is that depicted in FIG. 1. The casing 12 of lighting accessory 10 has two holes 14 formed therethrough, which are spaced whereby the lock hasp B extends through both holes 14 as depicted.

Although many variations of switching means are possible, a simple push button switch 16 may be used. Incorporated within the circuitry are means which cause the light source in lighting accessory 10 to light for a predetermined time period (such as fifteen seconds) without the user having to keep depressing the switch 16. Such circuitry is well known in lighting accessory arts (such as the push button lights involved with wristwatches, such as are sold under the INDIGLO brand name).

Lighting accessory 10 can easily be positioned on the hasp B of an existing pad lock A. Although lock hasp B is moved as the lock A opens, and one side of lighting accessory 10 may be disengaged from pad lock A, lighting accessory 10 will remain in stable engagement with pad lock A because of the continued engagement via the second hole 14 on the side of pad lock A where no gap opens between hasp B and the rest of the body of pad lock A.

Referring to FIGS. 2, 3, 4 and 5, alternative embodiments of the present invention would be for use with locks which, instead of front-mounted dials as shown in FIG. 1, include lock base positioned dials C. Second lighting accessory 20 would be one which, in the preferred embodiment, snaps on to a lock having dials C, and projects light thereon. Second lighting accessory 20 would include a casing 22, at least two mounting clips 24 (which are slightly biased for a snap fit onto a lock), and a lighting panel 26. In lighting panel 26 is to be housed an elongate LED light source to provide relatively uniform lighting over all of the dials C. In this embodiment of the present invention, a preferred switching means may be one which is completely encased on casing 22 and which is actuated by merely squeezing the casing in a bulbous region 28. As with lighting accessory 10, lighting accessory 20 would include time delay features for actuating the light source of a predetermined time upon actuating the switching means.

Although not depicted in separate drawings a third embodiment of the present invention is to be incorporated into pad locks of new construction. Such an embodiment of the present invention will involve simply incorporating circuitry such as just described, into the lock case itself, and with light source and switching means which extend from the case. Present lock manufacturers may simply incorporate the circuitry and power sources thus far described into dead space provided by existing lock designs and provide orifices though which a light emitting member (bulb, LED, etc.) and some actuation means may extend. In the case of a front position dial (as in FIG. 1), a tiny light bulb would extend from a single orifice just above the dial reference marker found on most locks. On locks such as lock C described above, a protruding, elongate lighting panel or ridge would be involved.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A lighting accessory for a combination pad lock having one or more dials for operating the pad lock, said accessory comprising:

a casing member;

light emitting means for emitting light from a portion of said casing member in which said light emitting means is incorporated;

a power cell positioned inside said casing member and operably interfaced with said light emitting means for providing power to said light emitting means;

light actuation means operable from the exterior of said casing member and integrated into a circuit which includes said light emitting means and said power cell for reversibly actuating said light emitting means for emitting light and casting said light on said one or more dials; and casing attachment means for attaching said casing member to a pad lock in a position, relative to said pad lock, whereby said light emitting means, when actuated, casts light on said one or more dials of said pad lock.

2. The accessory of claim 1 wherein said casing attachment means comprises at first and second holes formed in said casing member through which first and second holes a lock hasp of said pad lock extends to engage said accessory with said pad lock and position said light emitting means for casting light on said lock's actuation dial or dials.

* * * * *